US005103216A

United States Patent [19]

Sisselman

[11] Patent Number: 5,103,216

[45] Date of Patent: Apr. 7, 1992

[54] IMPROPERLY INSERTED BATTERY DETECTOR

[75] Inventor: Ronald Sisselman, Aurora, Ill.

[73] Assignee: Pittway Corporation, Northbrook, Ill.

[21] Appl. No.: 491,567

[22] Filed: Mar. 9, 1990

Related U.S. Application Data

[63] Continuation-in-part of Ser. No. 365,085, Jun. 12, 1989.

[51] Int. Cl.[5] ..... G08B 23/00

[52] U.S. Cl. ..... 340/693; 116/315

[58] Field of Search ..... 340/693, 628-630, 340/636, 568; 116/315; 429/96-100; 324/426

[56] References Cited

U.S. PATENT DOCUMENTS

| | | | |
|---|---|---|---|
| 3,823,367 | 7/1974 | Kaye et al. | 324/426 |
| 3,887,393 | 6/1975 | LaRue, Jr. | 429/99 |
| 4,228,428 | 10/1980 | Niedermeyer | 340/628 |
| 4,471,346 | 9/1984 | Nelson et al. | 340/628 |
| 4,525,703 | 6/1985 | Bellino | 340/628 |
| 4,870,395 | 9/1989 | Belano | 340/693 |
| 4,881,063 | 11/1989 | Fawcett | 340/693 |
| 4,959,640 | 9/1990 | Hall | 340/693 |

*Primary Examiner*—Glen R. Swann, III
*Assistant Examiner*—Thomas J. Mullen, Jr.
*Attorney, Agent, or Firm*—Dressler, Goldsmith, Shore, Sutker & Milnamow, Ltd.

[57] ABSTRACT

A deflectable battery retaining member in a battery powered unit blocks the improper insertion of a battery into the unit. Further, the same member in the absence of a battery inhibits engagement of the cover of the unit thereto providing a visual indicator of the missing battery.

21 Claims, 8 Drawing Sheets

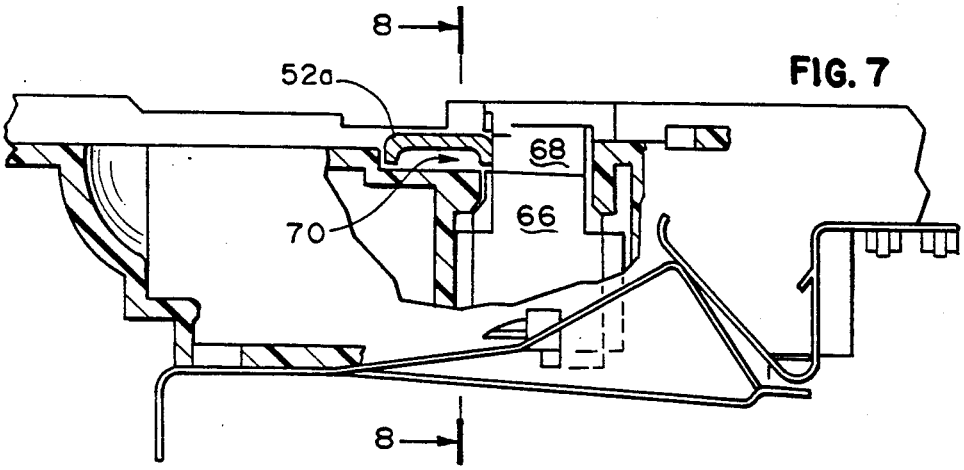
FIG. 7
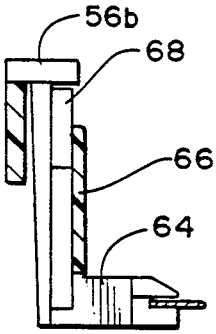
FIG. 8
FIG. 6
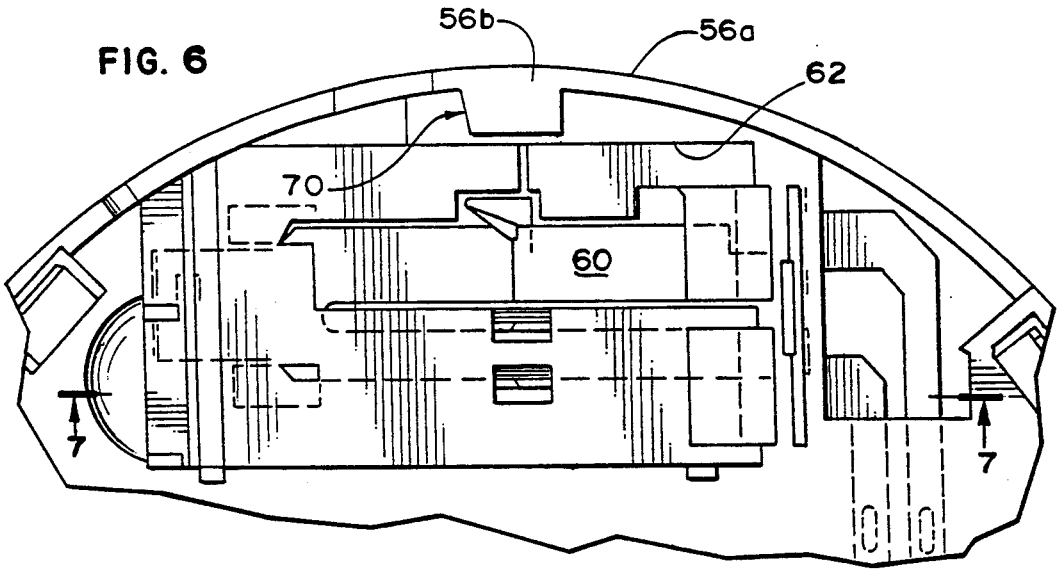

IMPROPERLY INSERTED BATTERY DETECTOR

This is a continuation-in-part of U.S. patent application Ser. No. 365,085 filed June 12, 1989.

FIELD OF THE INVENTION

The invention pertains to smoke detectors and the like. More particularly, the invention pertains to battery powered smoke detectors and an apparatus for indicating the absence of a battery.

BACKGROUND OF THE INVENTION

Smoke detectors are very commonly found today in buildings of all types. Some of these smoke detectors are AC powered. Others are battery powered. Some include a combination of AC power and battery backup power.

Battery powered detectors, while very convenient and easy to install, have suffered from the drawback that a user of the building might not realize the unit needed a battery. As such, because there was no indicia of a missing battery, this condition could persist for a substantial period of time to and including the time when a fire strikes the building. At that point in time, the detector would of course not function and not give out the warning it was intended to provide.

This problem has been dealt with in at least two different ways in the prior art. In a one known prior art detector the battery is located in a drawer which is radially movable with respect to the base.

So long as the battery is positioned in the drawer, the drawer can be freely opened and closed. When the drawer is closed with the battery present, the detector can receive electrical energy from the battery.

When the battery is removed from the drawer, the drawer is locked open and cannot be closed. This provides a visual indication of the missing battery.

While the drawer approach does provide an acceptable solution to the battery indicator problem from a consumer's point of view, from a manufacturer's point of view, it tends to be rather expensive and complicated.

An alternate prior art battery missing indicator has been incorporated into a smoke detector which is intended to be removably affixed to a surface mounted bracket. The bracket might be mounted on the ceiling or the wall of a room.

In this detector, when no battery is installed in the unit, a movable obstruction member extends out of a portion of the base which is intended to be located adjacent the bracket.

The presence of the extending obstruction is intended to make it impossible to couple the detector to the bracket. When a battery is inserted into the base of the detector, the obstructing member is depressed within the base of the detector by the battery. The detector can then be coupled to the bracket.

The above solution is of course not usable with detectors which are directly mountable on a surface without a bracket.

Thus, there continues to be a need for a cost-effective and reliable battery indicator apparatus which can be incorporated into electrical units such as battery powered smoke detectors. In addition, there continues to be a need for a simple apparatus of this type which readily conveys, visually, the missing battery indication to anybody passing through or in the area where the detector is mounted.

SUMMARY OF THE INVENTION

In accordance with the invention, an electrical unit which can be powered at least in part by a battery includes a battery missing indicator. The unit, which for example could be, but is not limited to, a battery powered smoke detector, has a base with an openable cover. The cover can be hinged or completely removable from the base.

The base includes a deflectable member which is deflected from a non-locking position, in the absence of battery, to a locking position in the presence of the battery. A blocking member is carried by the openable cover.

When the cover is placed in position on the base, assuming that the battery is present, the cover can be locked thereto. When the cover is placed in position on the base, and the battery is missing, the location of the deflectable member keeps the cover from being locked to the base.

In one embodiment of the invention, the deflectable member urges the battery into contact with the unit's battery terminals. The location and orientation of the deflectable member make it virtually impossible to improperly insert the battery. In the absence of a battery the cover cannot be latched to the base and provides a visual battery missing flag.

In another embodiment, a blocking member carried on the cover will engage an improperly inserted battery and block closure. If the battery is properly inserted, the cover can be closed and latched to the base.

Numerous other advantages and features of the present invention will become readily apparent from the following detailed description of the invention and the embodiments thereof, from the claims and from the accompanying drawings in which the details of the invention are fully and completely disclosed as a part of this specification.

BRIEF DESCRIPTION OF THE DRAWINGS

FIG. 6 is a top plan view of a portion of the base of the detector of FIG. 5;

FIG. 7 is a view partly in section taken along plane 7—7 of FIG. 6;

FIG. 8 is a view partly in section taken along plane 8—8 of FIG. 7;

DETAILED DESCRIPTION OF THE PREFERRED EMBODIMENTS

Figure 1:
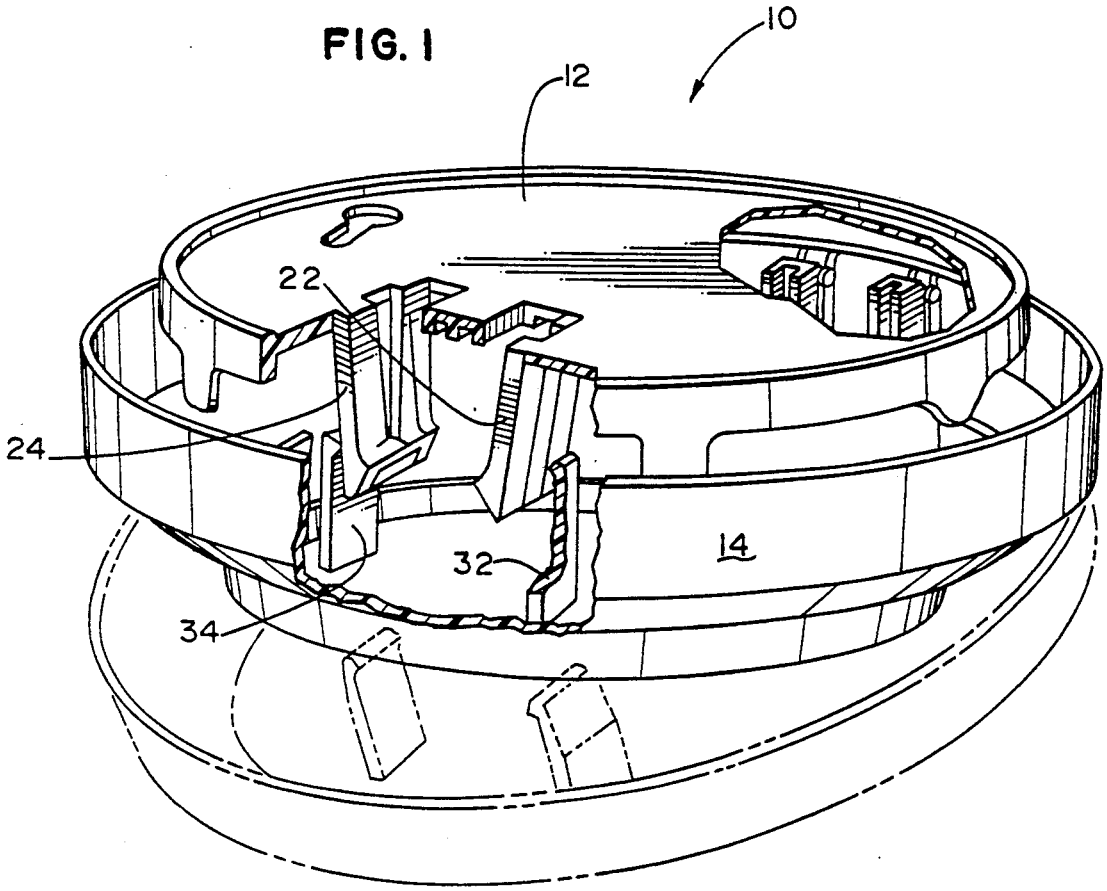
FIG. 1 is a partly broken-away view in perspective of a smoke detector in accordance with the present invention illustrating the characteristic of the cover hanging open in the absence of a battery.

While this invention is susceptible of embodiment in many different forms, there is shown in the drawings and will be described herein in detail a specific embodiment thereof with the understanding that the present disclosure is to be considered as an exemplification of the principles of the invention and is not intended to limit the invention to the specific embodiment illustrated.

In a first embodiment, a battery powered smoke detector 10 is disclosed which incorporates a battery missing indicator. The detector 10 has a latch mechanism which, in the absence of a battery, inhibits latching of a cover to the detector. Where the detector is mounted on a wall or a ceiling, the unlatched cover hangs from the detector or falls from the detector under the influence of gravity if not properly latched thereto. This provides a visible indicator of the missing battery.

With respect to the figures, FIGS. 1–4 illustrate the detector 10. The detector 10 has a base 12 and a cover 14. Both the base 12 and cover 14 can be molded of commercially available plastics.

Smoke detectors of various types are well-known. For example, U.S. Pat. No. 4,626,695, assigned to the assignee of the present invention, entitled "Photoelectric Composition Products Detector With Low-Power Consumption and Improved Noise Immunity" discloses circuitry and related apparatus for use in a photoelectric-type detector. U.S. Pat. No. 4,488,044 entitled "Ionization Chamber for Smoke Detector and the Like," assigned to the assignee of the present invention, discloses an ionization-type smoke detector. The disclosures of the '695 and '044 patents are hereby incorporated herein by reference.

The detector 10, which could be either an ionization-type or a photoelectric-type detector, is intended to be directly attached to a mounting surface via the base 12. The mounting surface can be either a ceiling or a wall.

The cover 14 can be opened for the purpose of replacing the battery B which at least in part powers the detector. The detector 10 can be completely powered by the battery B or it could be an AC powered unit with only battery backup. The cover 14 can be attached to the base 12 by means of a hinge or can be completely removable therefrom.

Figure 2:
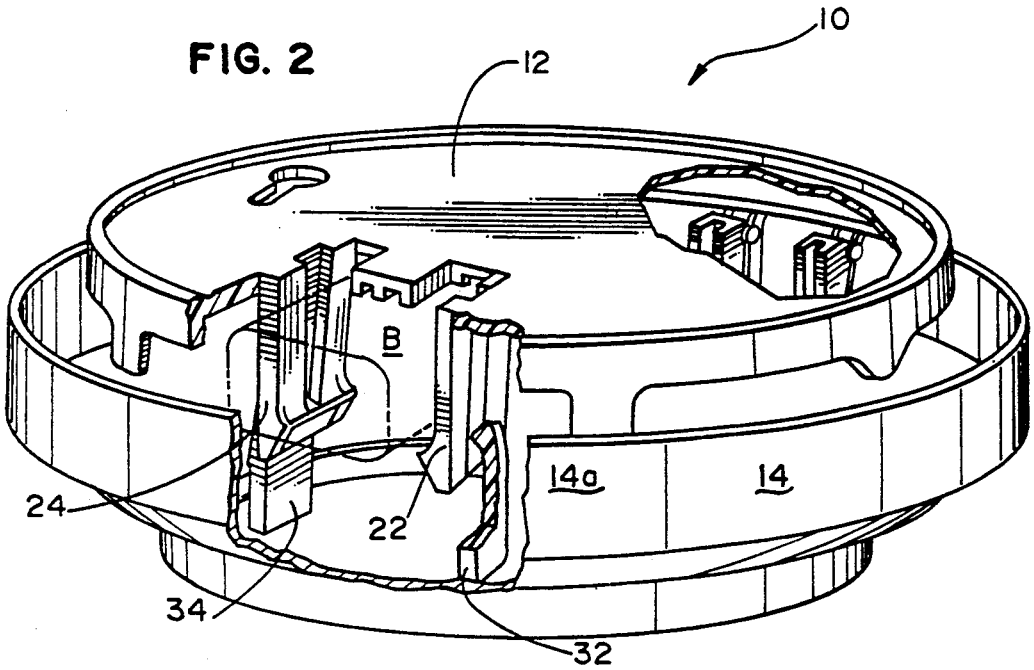
FIG. 2 is a perspective view in accordance with the present invention with the cover locked closed in the presence of a battery.

In FIG. 1, the battery is missing and, as illustrated, the cover 14 will not latch to the base 12. This provides a visual indicium of a missing battery. In FIG. 2, the battery B is present and the cover 14 is locked to the base 12.

Figure 3:
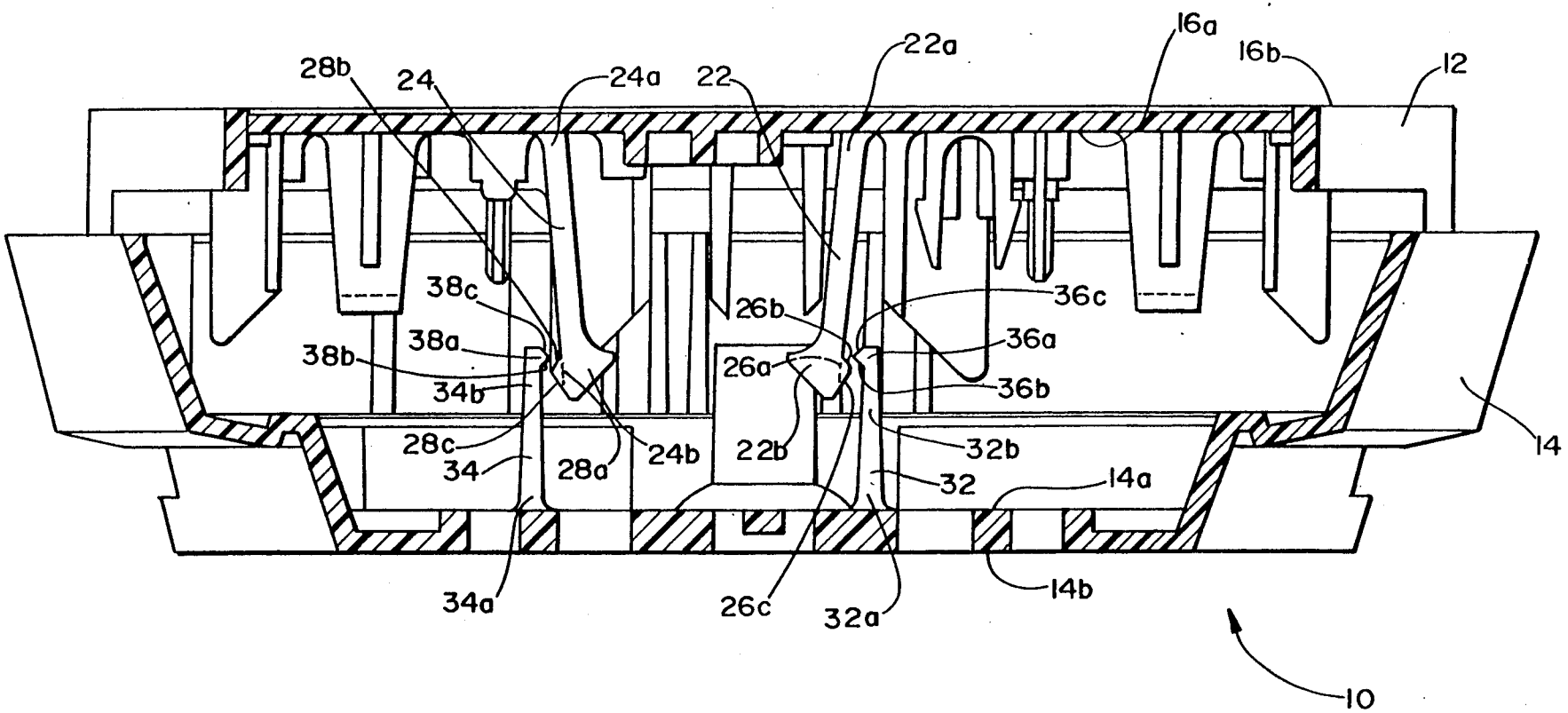
FIG. 3 is an enlarged view partly in section illustrating the locking mechanism and the interrelationships thereof in the absence of a battery.

With respect to FIG. 3, the base 12 is formed with an interior surface **16*a* and an exterior surface 16*b*. The exterior surface 16*b*** is positioned adjacent the mounting surface.

Carried on the interior surface **16*a* is a battery receiving region 18. In the detector 10, the battery receiving region 18 is fixed and is not movable with respect to the base 12**.

Adjacent the battery receiving region 18 are first and second flexible, elongated battery retaining members 22, 24. The members 22 and 24 are integrally molded with the base 12.

Each of the retaining members 22 or 24 has a first end **22*a* and 24*a* at which the respective member is attached to the base 12. Each retaining member has a second, free end 22*b* and 24*b***.

Each of the battery retaining members 22 or 24 carries, adjacent the respective second end, a laterally extending protrusion, **26*a* or 28*a*. The purpose of the protrusion 26*a* or 28*a* is to provide means for coupling the cover 14 to the base 12** in the presence of the battery B.

Each respective protrusion **26*a* or 28*a* has a locking surface 26*b* or 28*b*. In addition, each has a deflecting surface 26*c* or 28*c*. As described in more detail subsequently, the locking surfaces and the deflecting surfaces interact with members carried by the cover 14 for the purpose of coupling that cover to the base 12**.

The cover 14, which also can be molded of a variety of commercially available plastics has an internal surface **14*a* and an external surface 14*b*. Integrally molded with and attached to the surface 14*a* are spaced-apart elongated, deflectable cover locking members 32 and 34**.

Each of the cover locking members 32 and 34 has a first end **32*a* and 34*a* at which the respective locking member is connected to the cover 14. In addition, each locking member has a free second end 32*b* and 34*b***.

Each of the second ends carries a laterally extending locking, engaging prong **36*a* and 38*a*. Each of the locking engaging prongs has a locking surface 36*b* and 38*b* as well as a respective deflecting surface 36*c* and 38*c***.

The detector 10 would also include standard types of combustion product detector circuitry as disclosed in either the '044 or '696 patents incorporated herein by reference. The exact details of such circuitry are not a limitation of the present invention.

As illustrated in FIGS. 1–4, in the absence of the battery B, the battery retaining members 22, 24 are inwardly oriented with respect to the cover locking members 32, 34 and do not engage same. Hence, in this condition, the cover 14 is not locked to the base 12, thereby providing a visual indication of the missing battery. In this instance, the cover will either hang open with respect to the base 12 and will not stay closed or if the cover 14 is not hinged on the base 12, it will fall off of the base 12 under the influence of gravity.

Figure 4:
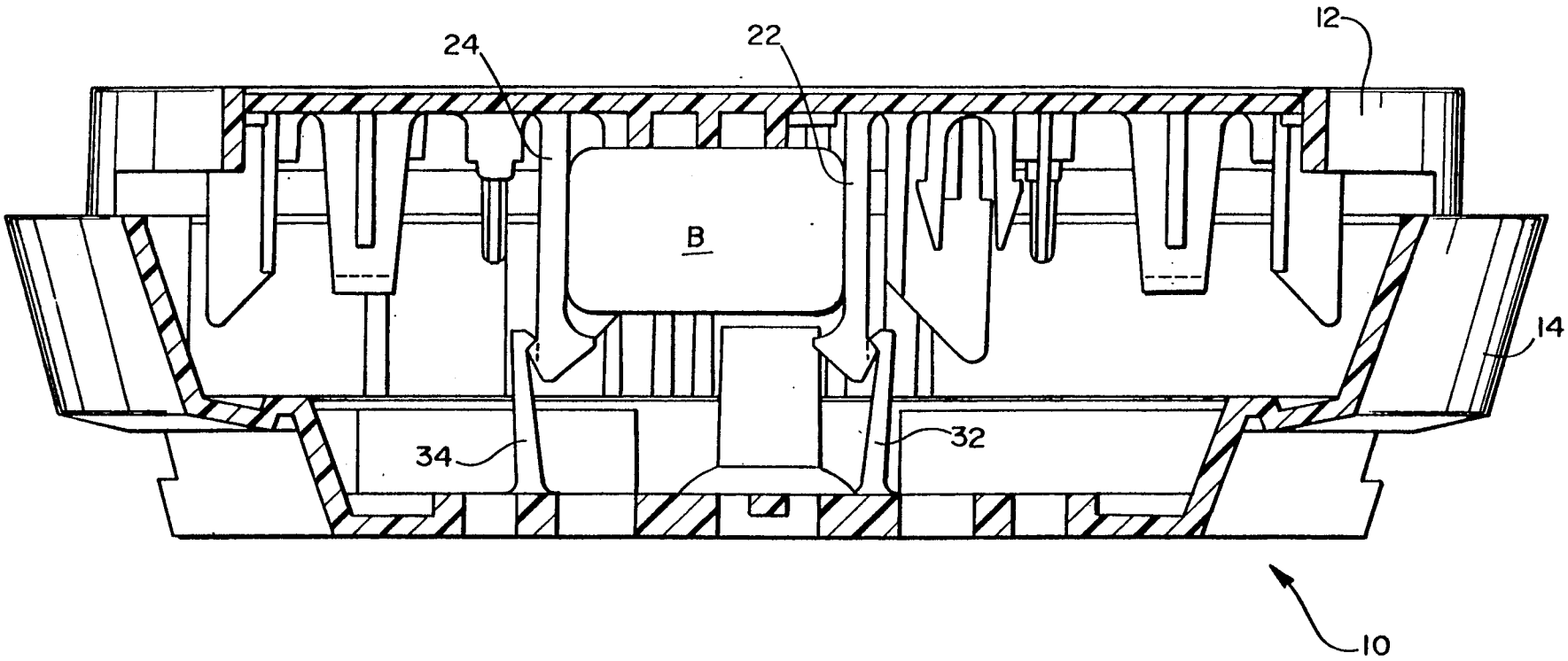
FIG. 4 is an enlarged view partly in section illustrating the interrelationships of the locking mechanism in the presence of a battery.

As illustrated in FIG. 4, when the battery B is inserted into the battery retaining region 18 between the retaining members 22 and 24, the free second ends **22*b* and 24*b* of each member are deflected in response to the presence of the battery B toward a respective one of the cover locking members 32 and 34. The degree of deflection of the members 22 and 24 which is brought about by the battery B is extensive enough such that when the cover 14 is then closed on the base 12, deflecting surfaces 26***c* and 28*c* of the respective battery retaining members 22 and 24 slidably engage respective deflecting surfaces 36*c* and 38*c* of the cover locking members 32 and 34. These two sets of respective surfaces slide against one another as the cover 14 approaches the base 12. This cooperative interaction in turn forces the respective free ends 32*b* and 34*b* of the cover locking members 32 and 34 outwardly away from the battery retaining members 22 and 24.

When the cover 14 is essentially closed against the base 12, the locking surfaces 26*b* and 28*b* of the battery retaining members 22 and 24 slidably engage the locking surfaces 36*b* and 38*b* of the cover locking members 32 and 34 as illustrated in FIG. 3. To this condition the cover 14 will be locked to the base 12. This provides a visual indication that the battery B is present in the detector 10.

As illustrated in FIG. 4, in the closed and locked condition, the battery retaining members 22 and 24 are essentially perpendicular with respect to the surface 16*a*. The cover locking members 32 and 34 in contradistinction are deflected outwardly with respect to the battery B and form an acute angle with respect to the surface 14*a*.

The cover 14 can be opened by pulling a region 14*a* away from the base 12. This pulling force in turn causes the locking surfaces 26*b* and 28*b* to disengage the locking surfaces 36*b* and 38*b*.

It is understood, of course, that the battery B would be coupled to circuitry of the type disclosed in the '695 or '044 patents noted previously for the purpose of powering the detector 10 or providing back-up power thereto.

In an alternative embodiment, where a detector is to be attached to a mounting bracket as opposed to directly to a mounting surface, a missing battery indicator can also be provided. In this embodiment, the missing battery indicator is operative to inhibit the coupling of the detector to the mounting bracket in the absence of the battery.

Figure 5:
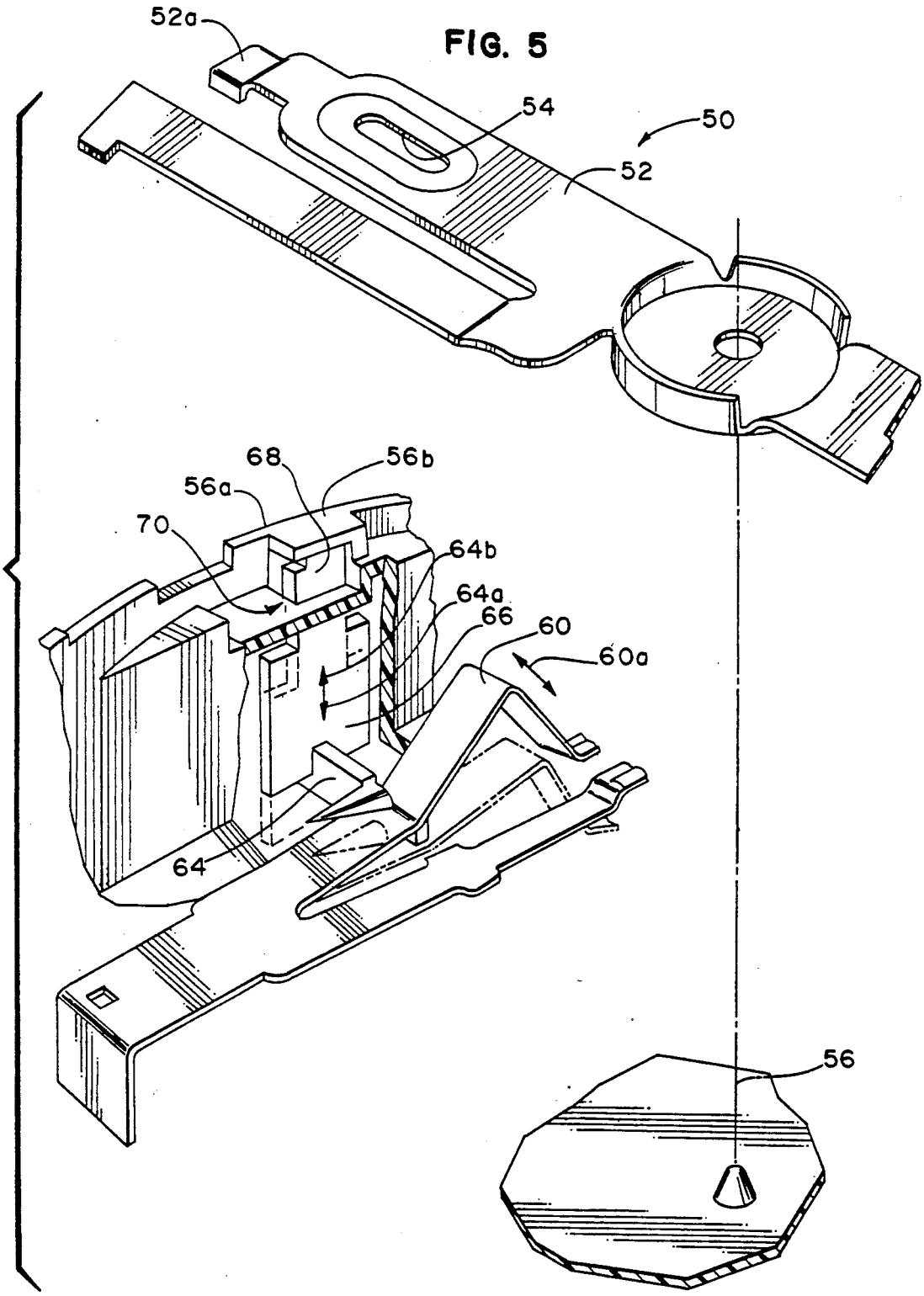
FIG. 5 is an enlarged fragmentary view, partially broken-away, of an alternate smoke detector in accordance with the present invention.

FIG. 5 illustrates a portion of a bracket mountable smoke detector 50. The detector 50 includes a bracket 52 which can be attached to a wall or a ceiling surface via screws or other such fasteners via openings 54.

The intent of the bracket 52 is to provide an easily mountable member to which the base of the detector 50 can be coupled using a rotary motion. A portion of the base 56 is illustrated in FIG. 5. The base 56 could be analogous to the base 12, with the difference that it is intended to be mounted on the bracket 52 as opposed to directly mounting on a ceiling or wall surface.

A peripheral portion 56*a* of the base 56 is illustrated in FIG. 5. The base 56 in a non-movable battery receiving region carries a deflectable spring member 60. The spring member 60 can be moved axially with respect to the cylindrical base 56 as indicated at 60*a* by inserting a battery B into the battery receiving region 62. In response to the inserted battery, the spring member 60 is deflected away from a surface 56*b* of the base 56.

Coupled to the spring member 60 is an extension arm 64. As the spring member 60 moves in response to the inserted battery, the extension arm 64 is carried therewith. Coupled to the extension arm 64 is a blocking member 66 which carries a blocking extension 68. The blocking extension 68 moves in a first direction 64*a*, in response to a battery being inserted, which is away from the upper peripheral surface 56*b*. When the battery is removed, the spring 60 returns to its resting position and the member 68 moves in the opposite direction, in a direction 64*b* toward the upper peripheral surface 56*b*. In this condition, the member 68 extends into and closes a portion of a region 70.

Figure 10:
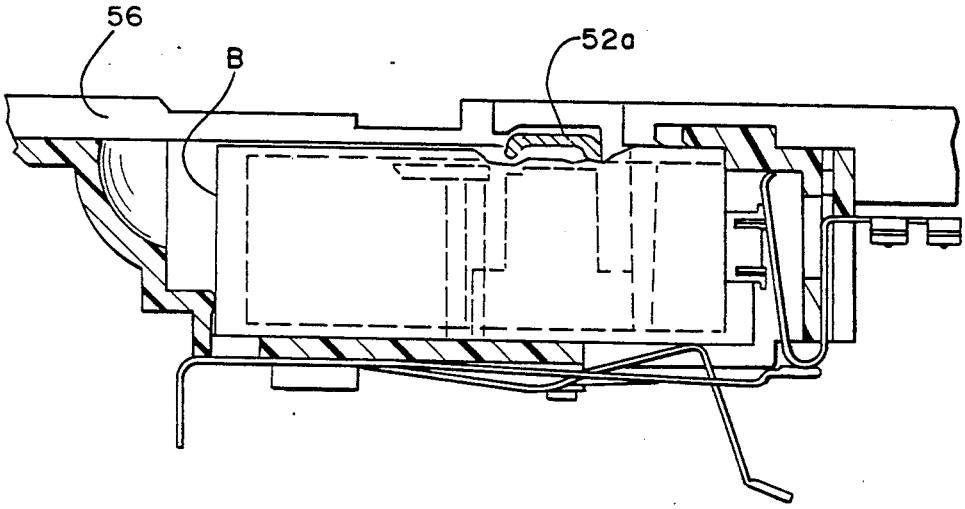
FIG. 10 is a view partly in section taken along plane 10—10 of FIG. 9.
Figure 9:
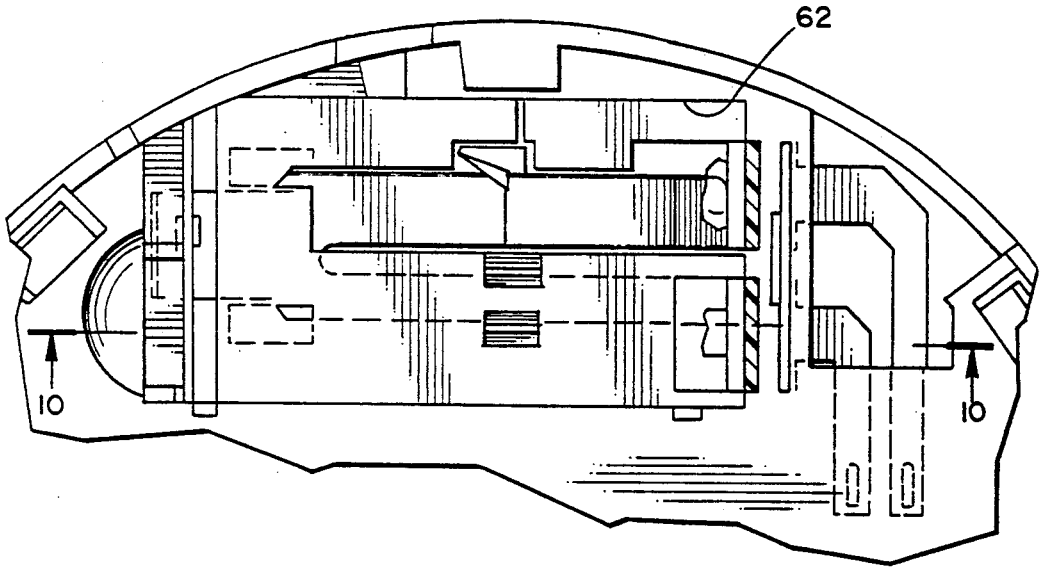
FIG. 9 is a top plan view of a portion of the base of the smoke detector of FIG. 5 with an installed battery.

FIGS. 6, 7 and 8 illustrate the mechanism of the detector 50 in FIG. 5 when the battery B is absent from the battery receiving region 52. FIGS. 9 and 10 illustrate a portion of the base 56 when the battery B illustrated in phantom in FIG. 9, has been inserted into the battery retaining region 62. When the battery B has been inserted into the battery retaining region 62, as discussed previously, the member 68 is retracted in the direction 64*a*, thereby completely opening the region 70. In this instance, an extension finger 52*a* of the bracket 50 can be rotatably and slidably inserted into the region 70, thereby locking the base 56 to the bracket 52. In contradistinction, when the battery B is not present in the battery receiving region 52 and the member 68 is moved upwardly in the direction 64*b* thereby blocking at least in part the region 70, the extension 52*a* is unable to enter the region 70 thereby blocking the detector from being locked to the bracket 52, notwithstanding the fact that the detector base 56 can be positioned against the bracket 52 as it normally would be. In this instance, twisting the base 56 is not effective to lock the base to the bracket 52 in view of the fact that the region 70 has been blocked by the member 68.

In yet another embodiment, in addition to providing a visual indication of the presence or absence of a battery, it is possible to determine whether or not the battery B has been correctly inserted into the detector. FIG. 7 illustrates a detector 80 which utilizes a battery B at least for powering the detector in part. The detector 80 can be the same type of detector which is directly surface mountable using a base 82 as illustrated in FIGS. 1–4. Alternately, the detector 80 could be a bracket mounted type as illustrated in FIGS. 5–10. In this instance, the base 82 would have a region corresponding to the region 70 into which the member 68 can move so as to block the coupling of the mounting bracket, such as the bracket 52 to the base 82.

Figure 11:
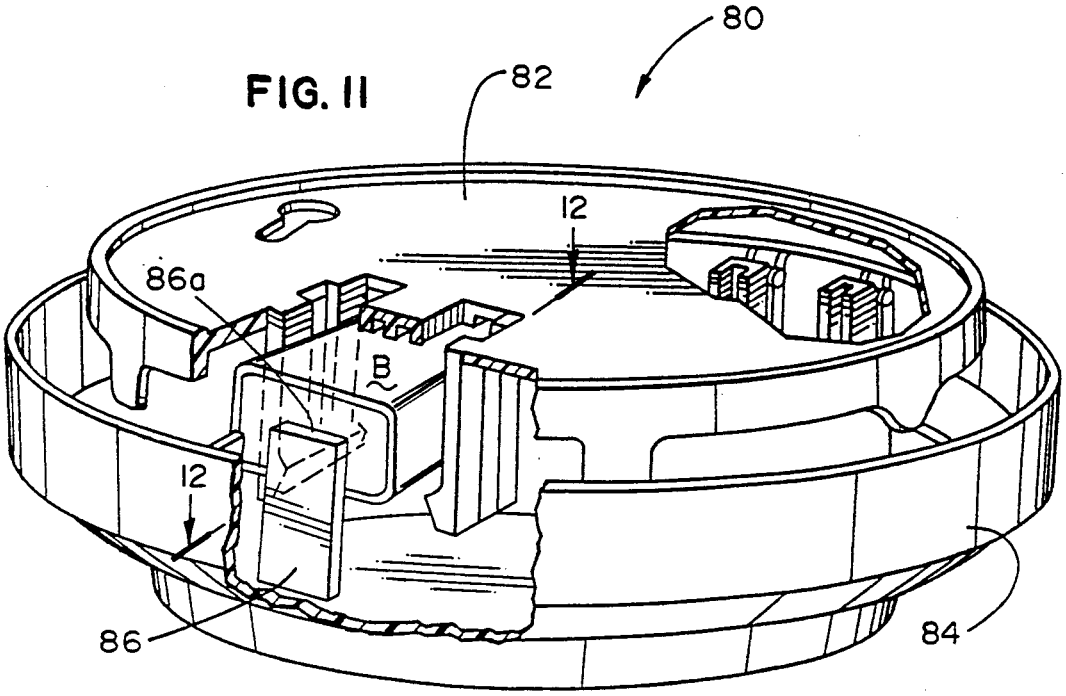
FIG. 11 is a perspective view, partially broken-away, of a smoke detector incorporating yet another embodiment of the present invention.

With respect to FIG. 11, coupled to the base 82 is a cover 84. The cover 84 carries a battery-sensing extension member 86. The member 86 can be integrally molded with the cover 84 simultaneously with formation of the cover.

Figure 12:
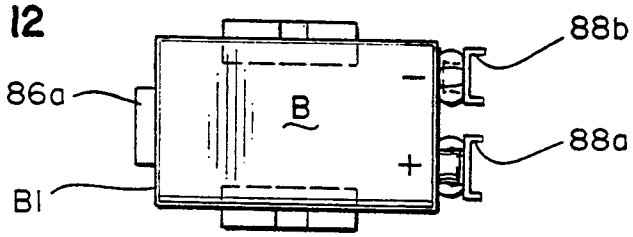
FIG. 12 is a top plan view of a properly inserted battery illustrating the relationship with the terminals thereof.
Figure 13:
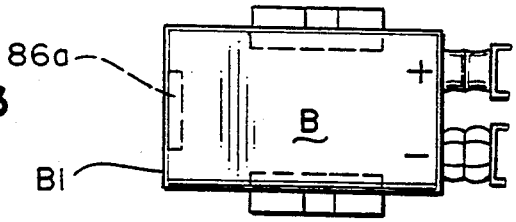
FIG. 13 is top plan view of an improperly inserted battery.
Figure 14:
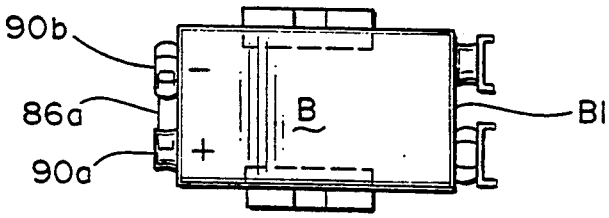
FIG. 14 is a top plan view of another improperly inserted battery.

As illustrated in FIGS. 12–14, the member 86 is effective to detect when the battery B is properly coupled to connectors 88*a* and 88*b* in the detector 80. When the battery B is properly coupled to connectors 88*a* and 88*b* and the cover 84 is closed against the base 82, the member 86 will pass adjacent an end region B1 of the battery B, permitting the cover 84 to be locked to the base.

In the instance where the battery B is present in the base 82 but has not been properly engaged with the connectors 88*a* and 88*b*, as illustrated in FIG. 13, the battery B extends from the connectors 88*a* and 88*b* an additional distance such that the member 86 is blocked by the end region B1 of the battery. In this instance, the cover 84 cannot be locked closed against the base 82.

In a similar instance, if the battery B is inserted into the base 82 backwards such that the end region B1 is adjacent the connectors 88*a* and 88*b*, the end surface 86*a* of the member 86 is obstructed by the terminals 90*a* and 90*b* of the battery. Hence, the cover 84 cannot be latched closed and locked to the base 82 in this instance either. Thus, the member 86 provides a sensing mechanism which makes it impossible to lock the cover closed when the battery is present in the unit but is improperly inserted therein.

Figure 15A:
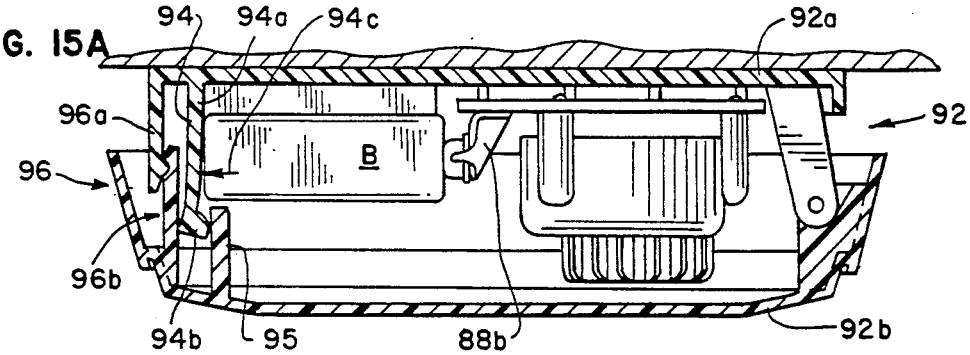
FIG. 15A is a view in section of an embodiment of the present invention illustrating various relationships in the presence of a battery.
Figure 15B:
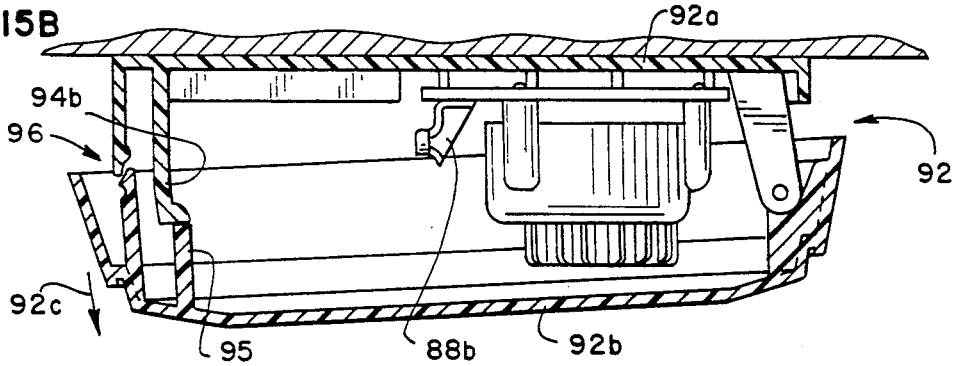
FIG. 15B is a view in section of the structure of the present invention illustrating relationships thereof in the absence of a battery.

FIGS. 15A and 15B illustrate another embodiment of an improperly inserted battery detector. With respect to FIGS. 15A and 15B, a detector 92, illustrated therein, has a base 92*a* and a hinged cover 92*b*.

Affixed to the base 92*a* is an integrally molded, deflectable, improperly inserted battery detector and battery retainer 94. The member 94 is integrally attached to the base 92*a* at a first end 94*a* and has a free second end 94*b*. Carried on the cover 92*b* is an integrally formed elongated and substantially rigid blocking member 95.

As illustrated in FIG. 15A, when a properly inserted battery B is present in the detector 92, the deflectable member 94 is moved in a direction 94*c* simultaneously while retaining the battery B in contact with the terminals 88*a* and 88*b*. The rigidity of the member 94 and spacing from the terminals 98 are such that battery B can only be inserted, as illustrated in FIG. 15A, with the terminals thereof properly engaging the terminals 88*a* and 88*b* as illustrated previously in FIG. 12. An attempt to improperly insert the battery B, as illustrated in FIG. 13 or in FIG. 14 previously will not succeed as the member 94 will not deflect adequately to permit such insertion.

However, when properly inserted the battery B deflects the member 94 enough such that the free end 94*b* is displaced away from the blocking member 95 when the cover 92*b* is closed against the base 92*a*. A latch mechanism 96 having a base mounted portion 96*a* and a cover mounted portion 96*b* can thus latch the cover 92*b* to the base 92*a* in the presence of the battery B.

Alternatively, as illustrated in FIG. 15B, when the battery B is absent, the blocking member 95 engages the sensing/battery retaining member 94*b* thereby inhibiting closure of the cover 92*b*. In this condition, the latch 96 is unable to latch the cover 92*b* to the base 92*a*. As a result, the cover 92*b* will swing open as illustrated at 92*c* serving as a visual flag indicating a missing battery.

With respect to the embodiment of FIG. 15A, it will be understood that the latch 96 could also be carried on the blocking member 95 and sensing member 94.

Figure 16A:
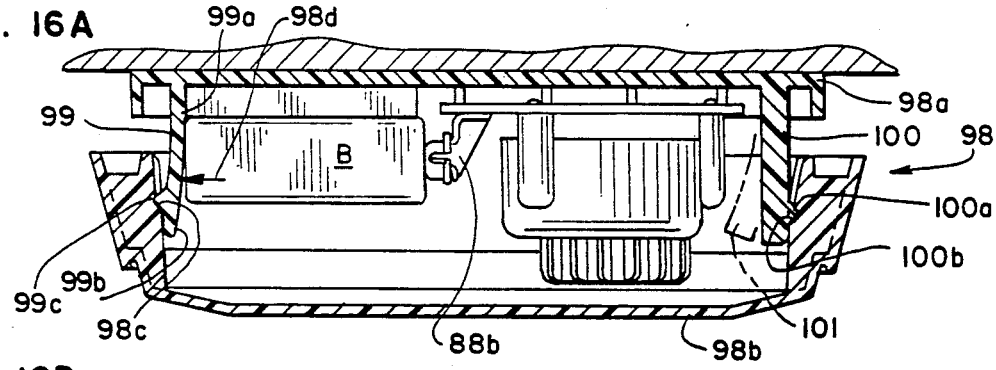
FIG. 16A is a view in section of yet another embodiment of the present invention illustrating interrelationships in the presence of a battery in a smoke detector having a moveable cover.
Figure 16B:
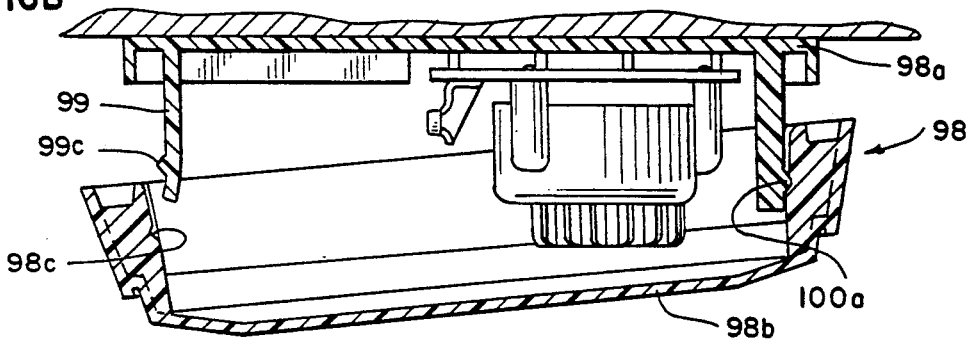
FIG. 16B is a view in section illustrating the relationships of the various structural members of the detector of FIG. 16A in the absence of a battery.

FIGS. 16A and 16B illustrate an embodiment 98 of a detector having a base 98*a* and a completely removable cover 98*b*. Carried on the base 98*a* is an integrally formed elongated, slightly deflectable, improperly inserted battery sensing and retaining member 99. The member 99 has a first end 99*a* integrally molded with the base 98*a* and a second free end 99*b*.

The member 99 is displaced from battery terminals 88*a* and 88*b* and is rigid enough that a battery B may not be inserted therebetween except with the correct electrical engagement as illustrated in FIG. 12 previously. The rigidity and location of the member 99 block improper insertion of the battery B.

A locking extension member 99*c* is carried on the deflectable member 99. The cover 98*b* includes a mating recess 98*c* for the locking member 99*c*.

A second locking member 100 carried on the base 98*a* and integrally formed thereon carries a corresponding locking member 100*a*. A second locking recess 100*b* is carried on the cover 98*b*.

In the presence of battery B, the deflectable sensing member 99 is deflected far enough in a direction 98*d* that the locking members 99*c* and 100*a* can lockingly engage respective recesses 98*c* and 100*b*. As a result, with the battery B present, the cover 98*b* will be retained on the base 98*a*.

FIG. 16B illustrates the detector 98 without a battery. In this instance, the member 99 has moved opposite the direction 98*d* far enough so that the locking members 99*c* and 100*a* are unable to lockingly engage the recesses 98*c* and 100*b*. In this instance, the cover 98*b* will not lock the base 98*a* and will fall therefrom.

The member 100 can also be formed with a slight curve therein, illustrated in phantom, 101, in FIG. 16A. If the detector 98 is mounted on a wall rather than the ceiling, in the absence of the battery B, the cover 98*b* will fall therefrom providing a visual indication of the missing battery.

From the foregoing, it will be observed that numerous variations and modifications may be effected without departing from the spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. A surface mountable electrical unit powered at least in part by a battery comprising a surface mountable base with the battery carriable thereon, a moveable cover closable against said base, and an essentially rigid member carried on said cover, oriented to block closure thereof against said base if the battery is not properly positioned in and electrically coupled to the unit.

2. A unit as in claim 1 including a member for latching said base to said cover in the presence of a properly positioned battery.

3. A unit as in claim 1 with a first surface of said rigid member engaging an improperly positioned battery thereby blocking closure of said cover against said base and with said first surface passing adjacent to a properly positioned battery thereby permitting closure of said cover against said base.

4. A unit as in claim 1 with said cover rotatably attached to said base by a hinge.

5. A unit as in claim 1 including a battery connector carried by said base for electrically coupling to the battery with said rigid member positioned to pass adjacent to a battery properly coupled thereto enabling said cover to close against said base.

6. An electrical unit powered at least in part by a battery comprising a base with the battery carriable thereon, a moveable cover closable against said base, and an essentially rigid member carried on said cover, oriented to block closure thereof against said base if the battery is not properly positioned in and electrically coupled to the unit; and a deflectable battery retaining member attached at a first end to said base with a second end movable between a battery missing location and a battery properly positioned location in response to the presence of the battery.

7. A unit as in claim 6 with said rigid member oriented to engage said retaining member in the absence of the battery.

8. An electrical unit powerable by a battery with a body portion having connectors extending from an end thereof comprising:

a base;

a battery terminal carried fixedly on said base; and a member carried on said base deflectable in response to the presence of a battery and spaced from said terminal thereby forming a battery receiving region therebetween sized only for the battery body.

9. A unit as in claim 8 including a hinge between said cover and said base.

10. A unit as in claim 8 including a blocking member carried on said cover for engaging said member.

11. A unit as in claim 8 including a cover and a latch carried at least in part on said cover for engaging only said deflected member.

12. An electrical unit, powered at least in part by a battery, comprising:

a base;

a cover closable against the base;

a battery connector carried on said base; and a rigid member attached to the cover for blocking closure of the cover against the base in the presence of a battery not properly coupled to said connector.

13. An electrical unit, powered at least in part by a battery, comprising:

a base;

a cover closable against the base;

a battery connector carried on said base; and means for blocking closure of the cover against the base in the presence of a battery not properly coupled to said connector.

14. A unit as in claim 13 with said connector fixedly carried on said base.

15. An electrical unit, powered at least in part by a battery with an elongated body, comprising:

a base;

a cover closable against the base;

a battery connector carried on said base;

a deflectable battery retaining member displaced from said connector and attached at a first end to said base with a second end thereof displaced in response to the presence of the elongated battery body between said member and said connector; and a rigid member, attached to said cover for engaging said second end in the absence of a battery and for not engaging same in the presence of a battery properly coupled to said connector.

16. An electrical unit as in claim 15 with said cover hinged to said base.

17. An electrical unit as in claim 15 including means for latching said base to said cover.

18. An electrical unit as in claim 17 with said latching means carried, in part, on said deflectable member.

19. An electrical unit as in claim 17 with said latching means carried, in part, on said cover.

20. An electrical unit as in claim 15 with said cover separate from said base and including a latch to said base only in response to the presence of a battery between said connector and said deflectable member and with said battery properly engaging said connector.

21. A surface mountable electrical unit with an openable cover, the unit powered at least in part by a battery receivable within a region thereof, comprising:

a planar base member positionable adjacent to the surface including means for holding said base member to the surface;

a structure for locking said cover to the unit;

means for sensing the presence of an improperly inserted battery; and means for inhibiting said locking function in response to a sensed improperly inserted battery.

* * * * *

UNITED STATES PATENT AND TRADEMARK OFFICE

CERTIFICATE OF CORRECTION

PATENT NO. :5,103,216

DATED :April 7, 1992

INVENTOR(S) :Ronald Sisselman

It is certified that error appears in the above-identified patent and that said Letters Patent is hereby corrected as shown below:

Column 10, line 23, after "a latch", insert --carried in part on said cover with said cover latchable--.

Signed and Sealed this

Seventeenth Day of August, 1993

Bruce Lehman

*Attest:*

BRUCE LEHMAN

*Attesting Officer*

*Commissioner of Patents and Trademarks*